US006470951B1

(12) United States Patent
Tao

(10) Patent No.: US 6,470,951 B1
(45) Date of Patent: Oct. 29, 2002

(54) STRUCTURE OF A BLIND ADJUSTMENT

(76) Inventor: Hsiu-Chih Tao, 2F, No. 937, Hwa Hsia Rd., Tso Ying Dist., Kaohsiung (TW)

( * ) Notice: Subject to any disclaimer, the term of this patent is extended or adjusted under 35 U.S.C. 154(b) by 0 days.

(21) Appl. No.: 09/715,158

(22) Filed: Nov. 20, 2000

(51) Int. Cl.[7] ..... E06B 9/26
(52) U.S. Cl. ..... 160/176.1 R; 160/295
(58) Field of Search ..... 160/171 R, 170 R, 160/176.1 R, 177 R, 168.1 R, 176 P, 168.1 P, DIG. 17, 293.1, 294, 295

(56) References Cited

U.S. PATENT DOCUMENTS 2,149,481 A * 3/1939 Bosch et al. ..... 160/168.1 P
2,229,221 A * 1/1941 Pratt ..... 160/171 R
3,559,024 A * 1/1971 Marder ..... 160/DIG. 17 X
4,550,759 A * 11/1985 Archer ..... 160/176.1 P
5,070,927 A * 12/1991 Chen ..... 160/171 R X
5,396,944 A * 3/1995 Rossini ..... 160/DIG. 17 X

* cited by examiner

*Primary Examiner*—David M. Purol
(74) *Attorney, Agent, or Firm*—Rosenberg, Klein & Lee

(57) ABSTRACT

A structure of a blind adjustment is operated by a rail and a shaft, and comprises a leading screw, a sliding seat, two confining parts, two adjustors and a housing. The leading screw is sleeved onto the shaft and having its two ends insert through connecting ends of the housing, respectively. The sliding seat and the confining parts are both threaded sleeved onto the leading screw and accommodating in the housing. The sliding seat will be linked by rotation of the leading screw to move whereas the two confining parts are designed to rotate without moving, thus upon one post of the sliding seat reaches to a protuberance of one of the confining part, the rotation of the sliding seat is blocked which then confines movement of the adjustor to adjust the height or angle of the blind.

2 Claims, 5 Drawing Sheets

STRUCTURE OF A BLIND ADJUSTMENT

FIELD OF THE INVENTION

This invention relates to the structure of a blind adjustment, and in particular to a confining design of an electric controlled blind.

BACKGROUND OF THE INVENTION

A conventional electrical window blind uses a micro switch to control the rolling on and off, but it can hardly change the angle of the blind and so forth. A recent design was developed, which secures a leading screw on a shaft with a sliding seat secured on the leading screw, thus, when rotating the leading screw, the sliding seat slides along the rail back and forth without rotation. The movement of the sliding seat will stop when it reaches to a bolt securing at one end of the shaft. However, in order to change the position of the bolt, many steps have to be taken. Further, the bolt will be forced directly by the sliding seat and will be ruined or damaged after a certain time of usage.

SUMMARY OF THE INVENTION

It is the primary object of the present invention to provide a structure of a blind adjustment, which is easy to operate and maintain.

It is another object of the present invention to provide a structure of a blind adjustment, which is more stable and lasts longer.

DETAILED DESCRIPTION OF THE PREFERRED EMBODIMENTS

Figure 1:
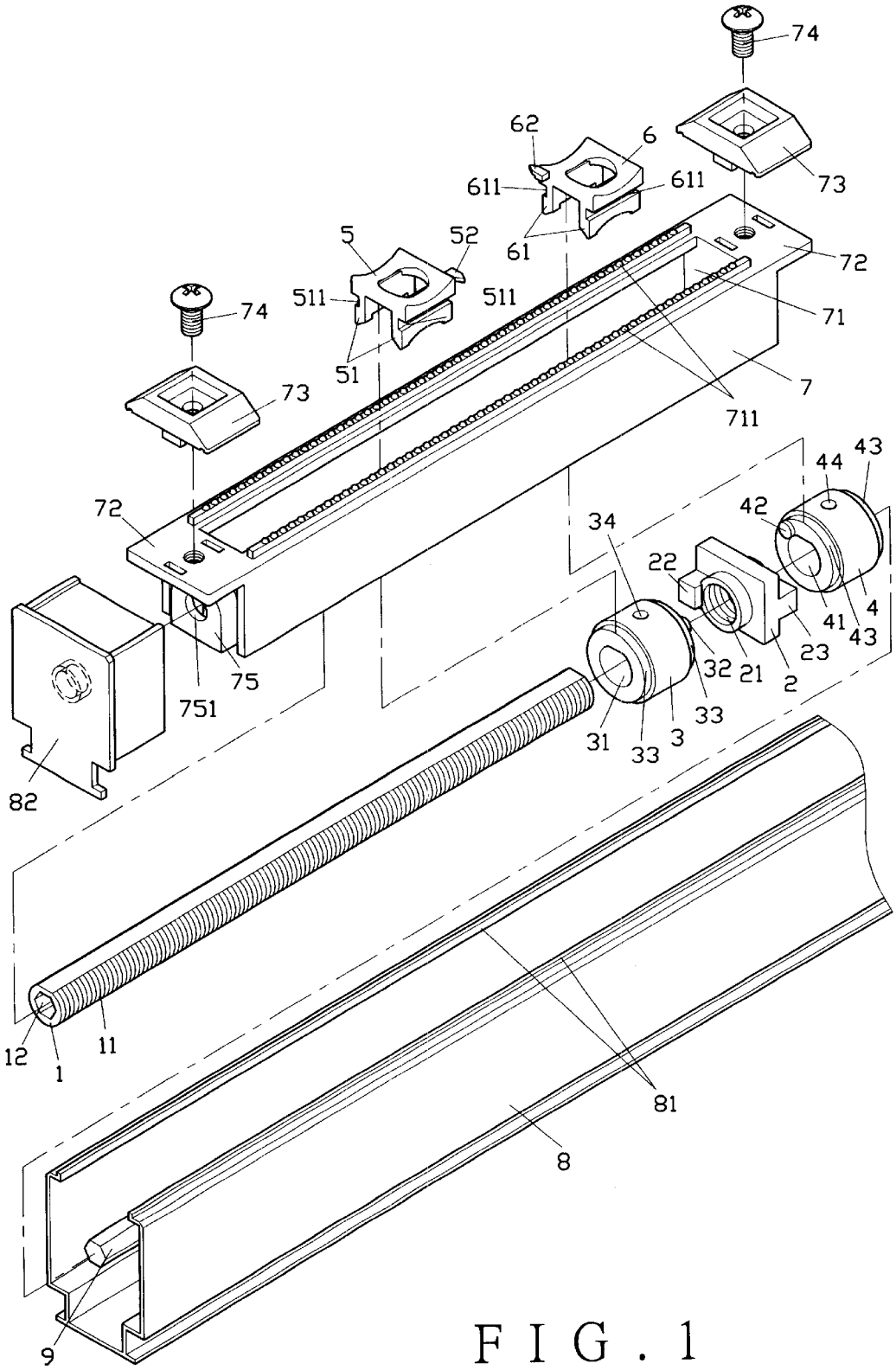
FIG. 1 is an exploded view of the present invention.
Figure 2:
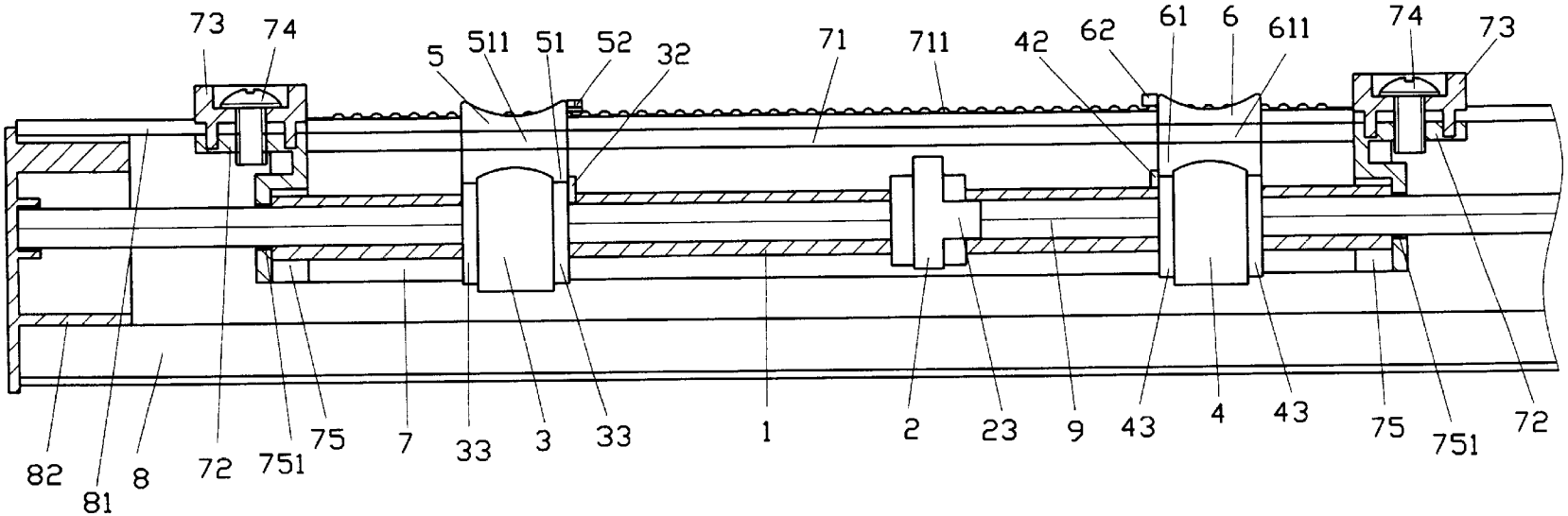
FIG. 2 is a cross sectional view along the length of the present invention.
Figure 3:
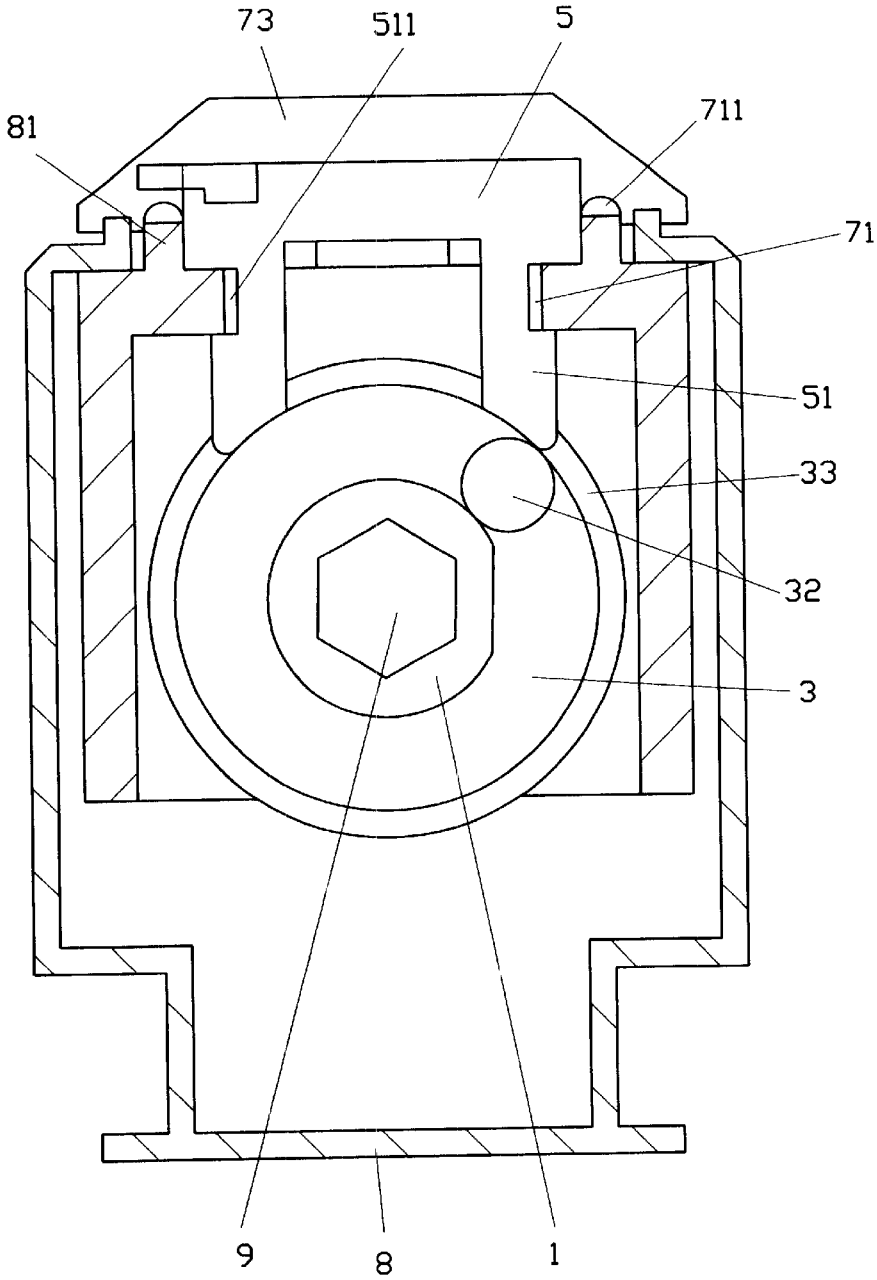
FIG. 3 is a front cross sectional view of the present invention.
Figure 4:
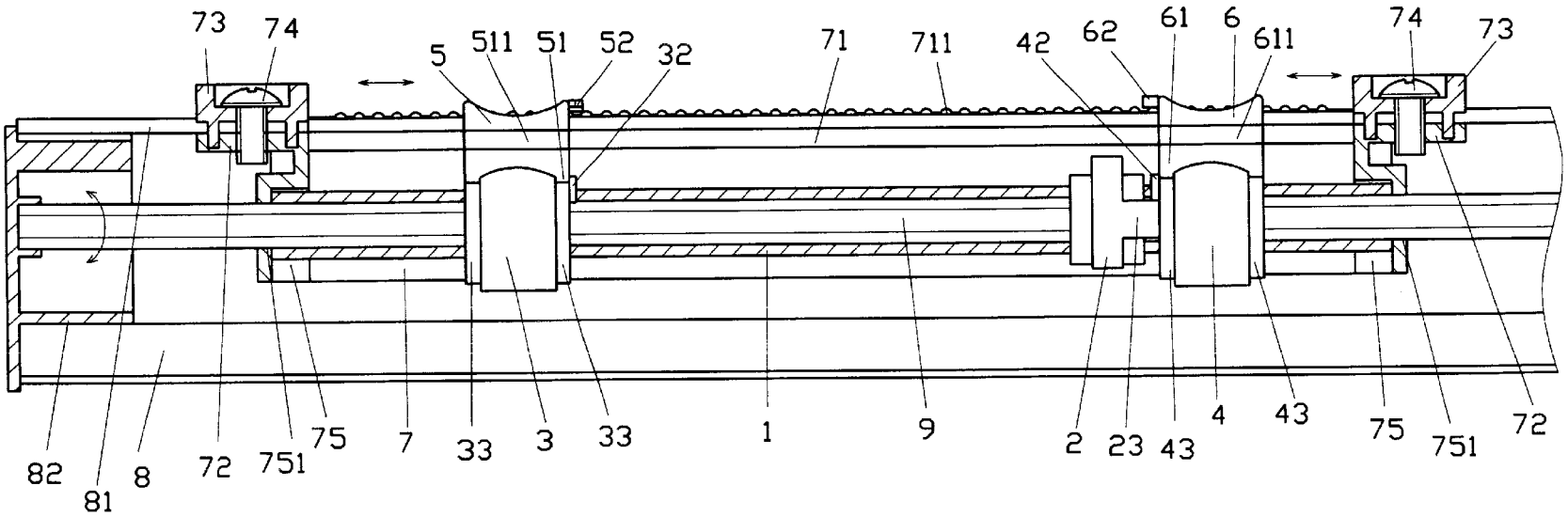
FIG. 4 is a cross sectional view similar to FIG. 2, in operation.
Figure 5:
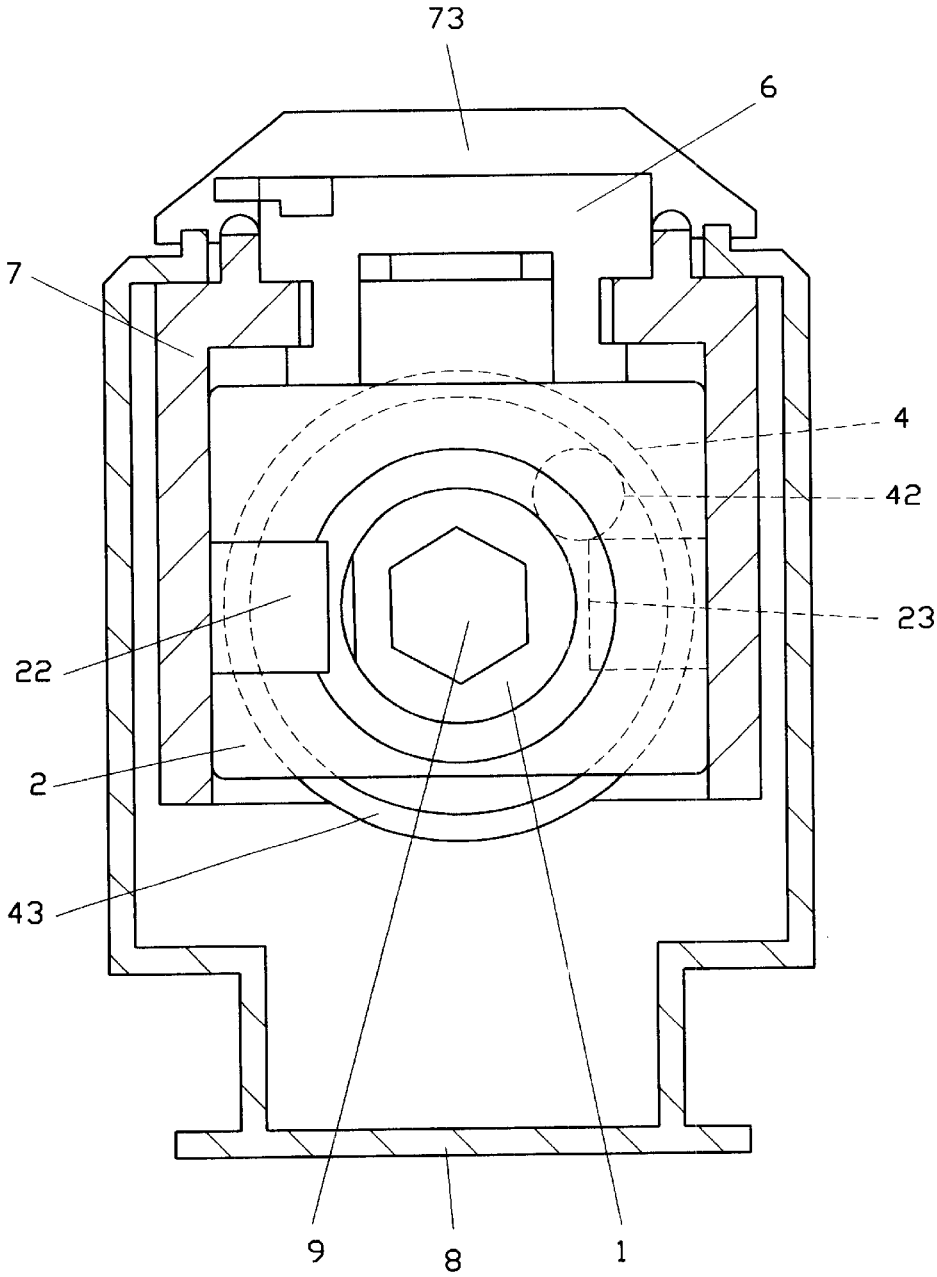
FIG. 5 is a front cross sectional view of the present invention in operation.

A structure of a window blind adjustment of the present invention comprises a leading screw 1, a sliding seat 2, two confining parts 3 and 4, two adjustors 5 and 6, a housing 7, a rail 8 and a shaft 9.

The leading screw 1 comprises outer threads 11 and a through hole 12 along its length, one side of which is milled.

The sliding seat 2 is a block having inner threads 21, which has a size that will fit into the housing 7 or the rail 8 and threaded sleeve onto the leading screw 1, the two ends are formed with posts 22 and 23 paralleling with the axle direction.

Coining parts 3 and 4 are in cylindrical shape, each comprises a big hole 31 and 41 at center extending along the length, and is slightly larger than the outer diameter of the leading screw 1, the parts 3 and 4 may be sliding when the leading screw 1 rotates. Each confining part 3 and 4 has a protuberance 32 and 42 facing towards the sliding seat 2, a pair of reduced portions 33 and 43 are formed at respective ends of the confining parts 3 and 4. The protuberances 32 and 42 are in the direction facing the sliding seat 2, while the reduced portions 33 and 43 are towards the sliding seat 2. Two through hole 34 and 44 are formed on each confining part 3 and 4 from the surface penetrating through and interconnecting with the hole 31 and 41, respectively. For the purpose of securing the confining parts 3 and 4 onto or as a manual adjustor on the leading screw 1 by means of bolts, which comprises a knob for handling purpose.

Each of the adjustors 5 and 6 is a piece with two claws 51 and 61 extending downward to engage with the reduced portions 33 and 43, a pair of slots 511 and 611 are formed above the claws 51 and 61 to be seated on the housing 7. The adjustors 5 and 6 are marked with indexes 52 and 62 for reading.

The housing 7 is a longitudinal box with its top and bottom left open. The top edge is formed with a ledge at respective sides as a sliding rail 71 with index 711 thereon. The top frame of the housing 7 is further extending a pair of fixing plates 72 from respective ends. Each fixing plate 72 has a hole for a bolt 74 to insert there through and secure a fixture 73 onto the rail 8. The housing 7 has a pair of connecting ends 75 at respective ends with a hole 751 at center thereof The rail 8 comprises a shaft 9, a ledge 81 on the top edges, and a cover 82 to seal the rail 8 from one end.

To assemble the present invention, threads the sliding seat 2 onto the leading screw 1 and the two confining parts 3 and 4 are also sleeved onto the leading screw 1 with one on each side of the sliding seat 2 and the protuberances 32 and 42 facing a corresponding post 22 or 23. The two ends of the leading screw 1 are inserted through the two connecting ends of the housing 7, respectively. The slots 511 and 611 of the adjustors 5 and 6 are clamping into the sliding rail 71, wherein the index 52 and 62 point the index 711. The claws 51 and 61 of the confining parts 5 and 6 seat on the reduced portions 33 and 43 that slides along the leading screw 1 with the confining parts 3 and 4.

Then, place the housing 7 into the rail 8 with the shaft 9 inserting into the leading screw 1, and secure the fixture 73 with the bolt 74 onto the two ends of the housing 7, and seal the rail 8 with the cover 82.

Further, a second embodiment is considered as not to use the housing 7, but to place the whole parts into the rail 8 direct.

In practice, rotating the shaft 9 links the leading screw 1 to rotate, which rotates the two confining parts 3 and 4 to rotate simultaneously, however, the adjustors 5 and 6 limit the parts 3 and 4 from sliding, whereas the sliding seat 2 will move along with the rotation of the leading screw 1 until the post 22 or 32 has reached to the protuberance 32 or 42 of the confining parts 3 or 4, then the sliding seat 2 will be stopped. To adjust the confining parts 3 and 4 simply by hand moves the parts 3 or 4 manually.

I claim:

1. A structure of a blind adjustment operating by a rail and a shaft, comprising a housing coupled to said rail, said housing having a longitudinally extended opening formed therein an a pair of sliding rails respectively formed on opposing longitudinal sides of said opening, said housing having at least one index formed adjacent a respective one of said sliding rails;

a longitudinally extended lead screw engaged on said shaft for rotation therewith and extending through said housing;

a sliding seat threadedly engaged on said lead screw for longitudinal displacement thereon responsive to rotation of said lead screw, said sliding seat having a pair of posts respectively disposed on opposing sides thereof;

two confining parts slidably disposed on said lead screw each of said confining parts being located on a respective one of said opposing sides of said sliding seat, each of said confining parts having a protuberance extending longitudinally towards said sliding seat; and, a pair of adjustors disposed in said opening of said housing and slidably engaged with said sliding rails, each of said adjustors being engaged with a respective one of said confining parts for longitudinal displacement thereof responsive to displacement of said adjustor, each of said adjustors having an index member extending therefrom and contacting said index of said housing to form a detent therewith.

2. The structure of a blind adjustment, as recited in claim 1, wherein each said confining part has a pair of reduced diameter portions formed on opposing sides thereof, and each said adjustor having a pair of claws at respective ends thereof for engaging said pair of reduced portions of a respective one of said confining parts.

* * * * *